United States Patent [19]

Ney, Sr.

[11] 4,444,588

[45] Apr. 24, 1984

[54] FREE MACHINING, COLD FORMABLE AUSTENITIC STAINLESS STEEL

[75] Inventor: Ronald P. Ney, Sr., Reading, Pa.

[73] Assignee: Carpenter Technology Corporation, Reading, Pa.

[21] Appl. No.: 342,848

[22] Filed: Jan. 26, 1982

[51] Int. Cl.[3] ..... C22C 38/16

[52] U.S. Cl. ..... 75/125; 75/128 P; 75/128 N; 148/38

[58] Field of Search ..... 75/128 P, 125, 128 N, 75/128 A; 148/38, 12 E

[56] References Cited

U.S. PATENT DOCUMENTS

| | | | |
|---|---|---|---|
| 2,697,035 | 12/1954 | Clarke, Jr. | 75/125 |
| 3,888,659 | 6/1975 | Ferree, Jr. | 75/128 P |
| 3,902,898 | 9/1975 | Denhard, Jr. et al. | 75/128 P |

FOREIGN PATENT DOCUMENTS

| | | | |
|---|---|---|---|
| 7327174 | 8/1968 | Japan | 75/128 P |
| 85657 | 6/1980 | Japan | 75/128 P |

OTHER PUBLICATIONS

Bloom et al., 39 ASM 843–867 (1947).

*Primary Examiner*—L. Dewayne Rutledge
*Assistant Examiner*—Debbie Yee
*Attorney, Agent, or Firm*—Edgar N. Jay

[57] ABSTRACT

A free machining cold formable austenitic stainless steel alloy and articles made therefrom which contains in weight percent about

| | w/o |
|---|---|
| Carbon | 0.15 Max. |
| Manganese | 4 Max. |
| Chromium | 14–20 |
| Nickel | 8–12 |
| Copper | 1.0–2.4 |
| Nitrogen | 0.2 Max. |
| Free Machining Additive | 0.02–0.25 |

with the balance iron and preferably no more than 2 w/o manganese, 1 w/o silicon, 0.04 w/o phosphorus, 0.08 w/o nitrogen. Also, the alloy preferably contains 1.4–2.0 w/o copper and the free machining additive is 0.08–0.14 w/o sulfur.

16 Claims, No Drawings

FREE MACHINING, COLD FORMABLE AUSTENITIC STAINLESS STEEL

This invention relates to austenitic stainless steel and, more specifically, to an austenitic stainless steel having a unique combination of good cold formability and machinability.

It has long been recognized that austenitic chromium-nickel stainless steels not only have generally poor cold workability, but they are also characterized by wide variations in how they respond to cold forming. Bloom et al, 39 ASM 843-867 (1947), demonstrated that increasing carbon from about 0.03% by as little as 0.01% sharply increased the cold work hardening rate of 18Cr-8Ni stainless until about 0.10% carbon content was reached. They also brought out that increasing nickel from 8% to 12% effectively rendered the steel insensitive to increases in carbon content insofar as cold work hardening was concerned.

U.S. Pat. No. 2,697,035, granted Dec. 14, 1954 to W. C. Clarke, Jr., relates to free machining austenitic chromium-nickel stainless steel containing 12-20% chromium, 6.5-15% nickel, 1 to about 5.0% copper, 0.1-0.5% sulfur and/or selenium, up to 0.5% phosphorus and the remainder iron. When Clarke characterizes his alloy in claim 4 as having an improved surface finish, the justmentioned composition is restricted to a range of 2.5 to about 5.0% copper. The alloys disclosed by Clarke in the table, Col. 3, have left much to be desired both with regard to their cold working properties and machinability as represented by surface finish.

The present invention is based upon the discovery that a unique combination of cold formability and machinability including good surface is, in fact, attainable when the amounts of copper added to control the composition's cold work hardening and the amount of free machining additives are carefully controlled as set forth hereinafter.

The foregoing, as well as additional objects and advantages of the present invention, are attained by providing a composition, summarized for convenience in Table I, as well as articles formed therefrom by both cold work and machining but not necessarily in that sequence, containing in weight percent (w/o) about

TABLE I

| | Broad | Preferred |
|---|---|---|
| Carbon | 0.15 Max. | 0.06 Max. |
| Manganese | 4 Max. | 2 Max. |
| Sulfur | 0.02-0.25 | 0.08-0.14 |
| Chromium | 14-20 | 16-19 |
| Nickel | 8-12 | 9-11 |
| Copper | 1.0-2.4 | 1.7-2.3 |

The balance of the composition is essentially iron, but that is not intended to exclude other elements customarily present in austenitic stainless steel in amounts varying from a few hundredths of a percent to one or two percent which do not objectionably detract from the desired properties and/or may enhance desired properties. Preferably, phosphorus is limited to a maximum (Max.) of about 0.04 w/o, molybdenum to about 0.5 w/o Max., and nitrogen to about 0.08 w/o Max. If desired, because of its beneficial effect in stabilizing austenite, up to about 0.2% nitrogen may be present but not in excess of the amount which can be retained in solid solution and only if the desired cold forming and machinability properties are not objectionably impaired. The best results thus far achieved were with nitrogen limited to no more than about 0.04 w/o.

Elements used in processing the melt when preparing the composition, e.g. deoxidation and refinement, should be selected which are compatible with the desired properties, and retained amounts thereof, if not beneficial as an alloying addition, are preferably kept low. Thus, in the case of silicon, the retained amount is preferably about 1 w/o Max. and, better yet, less than about 0.75%. On the other hand, because of its beneficial effect on machinability a minimum of about 1.5 w/o manganese is preferred.

Copper and sulfur each work to provide the unique combination of cold formability and free machinability characteristic of this invention. Below about 1.0 w/o, there does not appear to be sufficient copper present to significantly reduce the composition's cold work hardening rate. Preferably, at least about 1.3 w/o and, better yet, at least 1.4 w/o copper is present. For best results, a minimum of 1.7 w/o copper is present. Increasing copper above about 2.4 w/o does not have sufficient effect in lowering the work hardening rate to warrant the use thereof. In addition, it has been noted that increasing copper above about 2.0 w/o tends increasingly to affect adversely the machinability of the composition, as represented by the surface finish of the composition and by the increase in the lathe forces required at constant feed rates. Therefore, copper is limited to 2.4 w/o Max. and preferably to no more than 2.3 w/o even though larger amounts of copper may be beneficial in increasing tool life, another measure of machinability. While the mechanism by which copper affects the workability of the composition is not fully understood, it is apparent that the relatively small amount of copper present is effective to reduce the adverse effect of carbon reported by Bloom et al by about 50%.

In addition to carefully controlling the amount of copper present in this composition, it is also necessary to control equally carefully the amount of sulfur or other free machining additive present. Sulfur when present in too large an amount causes workpieces to split during cold forming. For that reason, sulfur is restricted to no more than about 0.25 w/o and, better yet, to no more than about 0.20 w/o. Preferably about 0.08-0.14 w/o is present.

While only sulfur has thus far been identified as a free machining additive herein, it is not intended to be restricted thereby. The ranges stated for sulfur are applicable to the well-known, free machining additives such as selenium, tellurium, phosphorus and others. Thus, by reference to 0.02-0.25 w/o, 0.02-0.20 w/o and 0.08-0.14 w/o sulfur, it is intended to include any one or more of those elements alone or in combination with sulfur.

It is also not intended by the foregoing tabulation of broad and preferred ranges to exclude any intermediate ranges formed by combining one or more of the broad upper or lower limits of certain elements with one or more preferred lower or upper limits. All such intermediate ranges are expressly included herein.

The composition of this invention is readily melted, shaped and heat treated using conventional practices. Preferably, the composition is melted in an electric arc furnace under slag. Refining and final alloying additions are preferably carried out in an argon, oxygen, decarburization (AOD) vessel. No special precautions need be taken when hot working, cold forming, machining or heat treating this composition than are customary for other 300 series austenitic stainless steels. Hot working can be carried out from 2100–2300 F. (1150–1260 C.), annealing from 1850–2050 F. (1010–1120 C.), preferably at about 1900 F. (1038 C.).

The following examples of the present invention were prepared and cast as small ingots having the composition indicated in Table IIA.

TABLE IIA

| Ex No. | C | Mn | S | Cr | Ni | Cu |
|---|---|---|---|---|---|---|
| 1 | .062 | 1.51 | .12 | 17.42 | 8.73 | 1.96 |
| 2 | .040 | 1.62 | .12 | 17.32 | 9.61 | 1.42 |
| 3 | .040 | 1.60 | .11 | 17.34 | 9.65 | 1.89 |

In each instance the balance was essentially iron which included 0.55–0.60 w/o silicon, 0.023–0.034 w/o phosphorus, less than 0.5 w/o molybdenum and less than 0.05 w/o nitrogen. The ingots were forged from a temperature of about 2200 F. (1200 C.) and annealed at 1900 F. (1038 C.) for one hour and then water quenched.

For comparison, the following compositions were prepared and treated as described for the previous examples

TABLE IIB

| Comp. | C | Mn | S | Cr | Ni | Cu |
|---|---|---|---|---|---|---|
| A | .064 | 1.47 | .33 | 17.43 | 8.70 | .40 |
| B | .036 | 1.59 | .11 | 17.30 | 9.67 | 2.79 |

As in the case of Examples 1–3, the balance of Compositions A and B was essentially iron. Composition A will be recognized as A.I.S.I Type 303. Composition B is an example of the material disclosed and claimed in the U.S. Pat. No. 2,697,035.

Standard (room temperature tensile property specimens were prepared from the thus treated material of Examples 1–3 and Compositions A and B having a 0.252 inch (0.640 cm) gage diameter and a 1 inch (2.54 cm) gage length. The 0.2% yield strength (Y.S.) and ultimate tensile strength (U.T.S.) in thousands of pounds per square inch (ksi) and megapascals (MPa) as well as the percent elongation (% El.) and percent reduction in area (% RA) are indicated in Table III. The as annealed Rockwell B (Rb) hardness of the material is also indicated.

TABLE III

| | .2% Y.S. | | U.T.S. | | | | |
|---|---|---|---|---|---|---|---|
| | ksi | (MPa) | ksi | (MPa) | % El. | % RA | Rb |
| Ex. 1 | 40 | (276) | 88 | (607) | 67.3 | 68.6 | 82 |
| Ex. 2 | 30 | (207) | 81 | (558) | 63 | 69 | 77.5* |
| Ex. 3 | 30 | (207) | 80 | (552) | 57 | 71 | 78* |
| Comp. A | 42 | (290) | 97 | (669) | 68.4 | 60.2 | 83 |

TABLE III-continued

| | .2% Y.S. | | U.T.S. | | | | |
|---|---|---|---|---|---|---|---|
| | ksi | (MPa) | ksi | (MPa) | % El. | % RA | Rb |
| Comp. B | 31 | (214) | 79 | (545) | 51 | 70 | 80* |

*Average of two measurements

Machinability of annealed specimens of Examples 1–3, Composition A and Composition B as measured by average drill penetration was tested and the results in inches (centimeters) are set forth in Table IV.

TABLE IV

| | Drill One | | | Avg. | Drill Two | | | Avg. | Overall Avg. |
|---|---|---|---|---|---|---|---|---|---|
| Ex. 1 | .304 | .274 | .281 | .286 | .278 | .277 | .282 | .279 | .282 |
| | (.772) | (.696) | (.714) | (.726) | (.706) | (.704) | (.716) | (.709) | (.716) |
| Ex. 2 | .304 | .301 | .300 | .302 | .229 | .240 | .229 | .233 | .267 |
| | (.772) | (.765) | (.762) | (.767) | (.582) | (.610) | (.582) | (.592) | (.678) |
| Ex. 3 | .261 | .256 | .252 | .256 | .254 | .261 | .286 | .267 | .262 |
| | (.663) | (.650) | (.640) | (.650) | (.645) | (.663) | (.726) | (.678) | (.665) |
| Comp. A | .359 | .366 | .379 | .368 | .388 | .358 | .398 | .381 | .344 |
| | (.912) | (.930) | (.963) | (.935) | (.986) | (.909) | (1.011) | (.968) | (.953) |
| Comp. B | .225 | .245 | .258 | .253 | .265 | .252 | .262 | .260 | .256 |
| | (.572) | (.622) | (.655) | (.643) | (.673) | (.640) | (.665) | (.660) | (.650) |

In carrying out the drill penetration test, the holes were drilled under carefully controlled conditions, two sets of three with each of two drills. The depth of each hole was then carefully measured to the nearest 0.001 inch (0.0025 cm) with the results as recorded in Table IV. The greater drill penetration obtained with Composition A resulting from the presence of about three times as much sulfur was to be expected. However, as is generally well known, Type 303 can only be cold worked with great difficulty and for practical purposes is unsuited for cold working. On the other hand, Composition B, as was seen, is representative of the U.S. Pat. No. 2,697,035 and, on comparison with Examples 1–3, shows that copper above 2.5% does not improve drill penetration. On the other hand, such excessive amounts of copper in the present composition tend to impair machinability as measured by surface finish.

Tool post dynamometer lathe forces were tested at 130 surface feet per minute (SFPM) at four different constant feed rates giving an average feed rate of 0.00554 inches per revolution (ipr), the average resultant force at that rate of feed was calculated using logarithmic solutions and the results are tabulated in Table V.

TABLE V

| | Avg. Force | |
|---|---|---|
| | lb | (kq) |
| Ex. 1 | 148.4 | (67.31) |
| Ex. 2 | 137.6 | (62.41) |
| Ex. 3 | 143.4 | (65.05) |
| Comp. A | 142.2 | (64.50) |
| Comp. B | 151.9 | (68.90) |

Here again, it is apparent that the beneficial effect of copper is derived primarily from relatively small amounts, and that copper additions above about 2.5% cannot be said to be beneficial and is believed shown to be detrimental.

The effect of composition variations on cold workability were examined by means of strain controlled compression tests. The tests were carried out on a Tinius Olsen tensile machine at a crosshead speed of 0.1 inch (0.25 cm) per minute on specimens in the form of cylinders 0.75 inch (1.91 cm) long and 0.5 inch (1.27 cm) in diameter. Measurement was carried out of the force required to reduce the length of each specimen in successive increments of 0.050 inch (0.13 cm) to an overall reduction in length of about 63% in the case of Example 1 and Composition A and to about 67.5% reduction in the case of Examples 2 and 3, and Composition B. The data obtained clearly showed the beneficial effect of increasing copper on reducing the cold work hardening rate of the material. However, above about 2 w/o, e.g. above about 2.4 w/o, there is not sufficient benefit derived from further additions of copper to warrant the accompanying impairment of free machinability as represented by surface finish and lathe tool forces.

Because of its improved combination of cold workability and machinability, cold worked and machined articles are readily and advantageously made from this composition. Thus, this composition is advantageously utilized in the manufacture of articles requiring any cold work operations such as heading, upsetting, drawing and/or coining and any machining operations such as threading, fluting, knurling, spiraling, slotting, drilling, tapping or turning. Such articles include fasteners, e.g. wing nuts and eyebolts, connectors, fittings, clevis pins, tubular articles such as rivets, and extruded articles such as washers.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed.

What is claimed is:

1. A free machining cold formable austenitic stainless steel alloy consisting essentially in weight percent of about

| | w/o |
|---|---|
| Carbon | 0.15 Max. |
| Manganese | 2 Max. |
| Chromium | 14–20 |
| Nickel | 8–12 |
| Copper | 1.3–2.4 |
| Nitrogen | 0.2 Max. |

at least one element as a free machining additive in an amount of about 0.02–0.14 w/o, and the balance essentially iron, said alloy by being limited to the stated amount of copper being characterized by good machinability as measured by surface finish and when subjected to at least about 63% cold reduction in the hereinbefore described strain controlled compression test said alloy has improved cold workability as evidenced by being essentially free from edge checking.

2. The alloy set forth in claim 1 in which the free machining additive is sulfur.

3. The alloy set forth in claim 1 or 2 which contains no more than about 2.0 w/o copper.

4. The alloy set forth in claim 3 which contains a maximum of about 2 w/o manganese, 1 w/o silicon, 0.04 w/o phosphorus, and 0.08 w/o nitrogen.

5. The alloy set forth in claim 1 or 2 which contains no more than about 2.0 w/o copper.

6. The alloy set forth in claim 5 which contains at least about 1.3 w/o copper.

7. The alloy set forth in claim 5 which contains at least about 1.4 w/o copper.

8. The alloy set forth in claim 5 which contains at least about 1.7 w/o copper.

9. The alloy set forth in claim 4 which contains at least about 1.3 w/o copper.

10. The alloy set forth in claim 4 which contains at least about 1.7 w/o copper.

11. The alloy set forth in claim 4 which contains no more than about 0.04 w/o phosphorus and about 0.08–0.14 w/o additional free machining additive.

12. The alloy set forth in claim 11 which contains about 1.4–2.0 w/o copper.

13. A machined and cold formed article comprising a free machining cold formable austenitic stainless steel alloy which consists essentially of about

| | w/o |
|---|---|
| Carbon | 0.15 Max. |
| Manganese | 2 Max. |
| Chromium | 14–20 |
| Nickel | 8–12 |
| Copper | 1.3–2.4 |
| Nitrogen | 0.2 Max. |

at least one element as a free machining additive in an amount of about 0.02–0.14 w/o, and the balance essentially iron.

14. The article set forth in claim 13 formed from an alloy which contains no more than about 1 w/o silicon, 2 w/o manganese, 0.08 w/o nitrogen, 0.04 w/o phosphorus, and in which the free machining additive is about 0.08–0.14 w/o sulfur.

15. The article set forth in claim 14 formed from an alloy which contains about 1.3–2.3 w/o copper.

16. The article set forth in claim 14 formed from an alloy which contains about 1.4–2.0 w/o copper.

* * * * *